US007905376B2

(12) United States Patent
Gouldson

(10) Patent No.: US 7,905,376 B2
(45) Date of Patent: Mar. 15, 2011

(54) SNAP IN LOWER NECK INDICATOR

(75) Inventor: Stanley F. Gouldson, Northport, NY (US)

(73) Assignee: Spotless Plastics Pty. Ltd., Moorabbin, Victoria (AU)

( * ) Notice: Subject to any disclaimer, the term of this patent is extended or adjusted under 35 U.S.C. 154(b) by 81 days.

(21) Appl. No.: 12/180,152

(22) Filed: Jul. 25, 2008

(65) Prior Publication Data

US 2010/0019002 A1 Jan. 28, 2010

(51) Int. Cl.
*A41D 27/22* (2006.01)

(52) U.S. Cl. ..... 223/85; 40/322

(58) Field of Classification Search ..... 223/85, 223/88, 92; 40/322; D6/328
See application file for complete search history.

(56) References Cited

U.S. PATENT DOCUMENTS

| | | | | |
|---|---|---|---|---|
| 4,006,547 | A * | 2/1977 | Samuels et al. | 40/322 |
| 4,198,773 | A * | 4/1980 | Batts et al. | 40/322 |
| 4,333,590 | A * | 6/1982 | Princiotta | 223/85 |
| 5,503,310 | A | 4/1996 | Zuckerman et al. | |
| 5,687,887 | A * | 11/1997 | Bond et al. | 223/85 |
| 5,884,422 | A | 3/1999 | Marshall et al. | |
| 5,913,462 | A * | 6/1999 | Petrou | 223/85 |
| 6,019,260 | A | 2/2000 | Gouldson | |
| 7,287,674 | B1 | 10/2007 | Sutton et al. | |
| 2006/0006204 | A1 * | 1/2006 | Mainetti | 223/85 |
| 2006/0213938 | A1 * | 9/2006 | Gouldson | 223/85 |
| 2007/0062984 | A1 * | 3/2007 | Louw | 223/85 |
| 2007/0199963 | A1 * | 8/2007 | Gouldson | 223/85 |

FOREIGN PATENT DOCUMENTS

| | | | |
|---|---|---|---|
| EP | 1 702 540 | A1 | 9/2006 |
| GB | 2 436 286 | A | 9/2007 |
| WO | WO 2006/005467 | A1 | 1/2006 |

OTHER PUBLICATIONS

Intellectual Property Office of United Kingdom Search Report dated Oct. 22, 2009 issued in corresponding application GB 0911052.9.

* cited by examiner

*Primary Examiner* — Gary L Welch
*Assistant Examiner* — Nathan E Durham
(74) *Attorney, Agent, or Firm* — Scully, Scott, Murphy & Presser, P.C.

(57) ABSTRACT

A combination hanger and indicator is disclosed. The hanger has a body and a hook extending upward from the body. The body includes a recess in a top surface thereof. The indicator has a top opening and a pair of opposite side walls connected by a pair of opposite end walls. The indicator further includes at least one resilient tab attached to a bottom surface thereof for engaging the recess in the top surface of the body.

20 Claims, 3 Drawing Sheets

SNAP IN LOWER NECK INDICATOR

FIELD OF INVENTION

The present invention relates to the field of garment hangers, and more particularly, to an indicator securable to a lower neck region of a hanger and a combination of the indicator and the hanger.

DESCRIPTION OF RELATED ART

In the area of retail garment sales, so-called Garment-On-Hanger (GOH) programs have become preferred by retailers. In a GOH program, garments are delivered to retail merchants already suspended from hangers, whereupon arrival at the retail location they may immediately be placed on display for sale. Formerly, retailers accomplished the task of suspending garments from hangers with labor provided at their own expense.

In particular, retailers have specified particular hangers or hanger characteristics among their several suppliers in order to achieve a visually pleasing uniformity on their sales floors. To this end, standards as to hanger size, shape, performance characteristics, etc., are maintained, for example, by organizations such as the Voluntary Inter-industry Commerce Standards Association (VICS). One particular standardized hanger feature is extremely popular across several hanger models, namely a turnable wire hook mated to a plastic hanger.

Additionally, and interrelated to the promulgation of GOH programs, retailers and their customers desire to have the hanger itself display some indicia regarding the item carried upon it. Categories of indicia could include manufacturer, material and price, but most notably for garments are their sizes. Various means for accomplishing this have been developed, including those disclosed in U.S. Pat. No. 5,884,422 to Marshal, et al., and U.S. Pat. No. 6,019,260 to Gouldson, both of which are commonly assigned with the instant application, among others. Popular among these are the type disclosed in the latter patent just mentioned, i.e., those that secure to the hanger adjacent the intersection of the hook and the hanger body to one side of the hook, appropriately called side-sizer tabs, or indicators.

However, such side-sizers heretofore known in the art require that the hanger be specifically manufactured to accept the particular indicator. Various other indicators could be made universally adaptable, for example those attached surrounding the wire hook of the hanger These generally are free to slide along the length of the wire hook, and ordinarily come to rest at the base of the hook adjacent the hanger body. However, these sizers do not securely engage with the hanger, nor achieve a desirable appearance. Particularly, these movable sizers may pose a safety issue to young children, who might inadvertently remove the sizers, and swallow or choke on the removable sizer. Therefore, a hanger having an indicator capable of securely engaging the hanger, especially as directly secured to the hanger body, is desirable.

BRIEF SUMMARY OF THE INVENTION

Therefore, provided according to the present invention is a combination hanger and indicator. The hanger has a body and a hook extending upward from the body. The body includes at least one recess in a top surface thereof. The indicator has a top opening and a pair of opposite side walls connected by a pair of opposite end walls. Specifically, the indicator includes at least one resilient tab attached to a bottom surface thereof for engaging the recess in the top surface of the body.

The recess may be optionally a step-wise recess, a concave recess, or a chamfer, sized and positioned to receive the resilient tab of the sizer. Each recess may include a niche that is sized and positioned to receive a projection of the resilient tab. The niche may include a generally horizontal surface for engaging the projection of the indicator, so as to limit the motion of indicator once the indicator is mounted to the hanger. Optionally, the projection also includes a generally horizontal surface opposite to the horizontal surface of the niche for positively accommodating the projection into the niche.

The side walls of the indicator may be generally trapezoidal in profile. Optionally, the resilient tab is attached to a central portion of the bottom surface of the end wall.

In another embodiment of the invention, the hanger body comprises two recesses in the top surface and the indicator comprises two corresponding resilient tabs. Optionally, the two resilient tabs are located on the opposite end walls of the indicator.

Furthermore, provided according to another aspect of the present invention is an indicator for a hanger having a body and a hook attached to the body. The indicator includes a top opening, a pair of opposite side walls connected by a pair of opposite end walls. At least one resilient tab is attached to a bottom surface of the indicator for engaging a recess in a top surface of the hanger body.

Furthermore, provided according to another aspect of the present invention is a hanger including a hanger body having at least one recess in a top surface thereof. The recess is sized and positioned to engage a resilient tab of an indicator attached to the hanger. The hanger further comprises a hook extending upward from the body for suspending die hanger from a support.

BRIEF DESCRIPTION OF THE DRAWINGS

These and other features, aspects and benefits of the present invention will be made apparent with reference to the following specification and accompanying drawings, wherein like reference numerals refer to like features across the several views, and wherein.

DETAILED DESCRIPTION OF THE INVENTION

Figure 1:
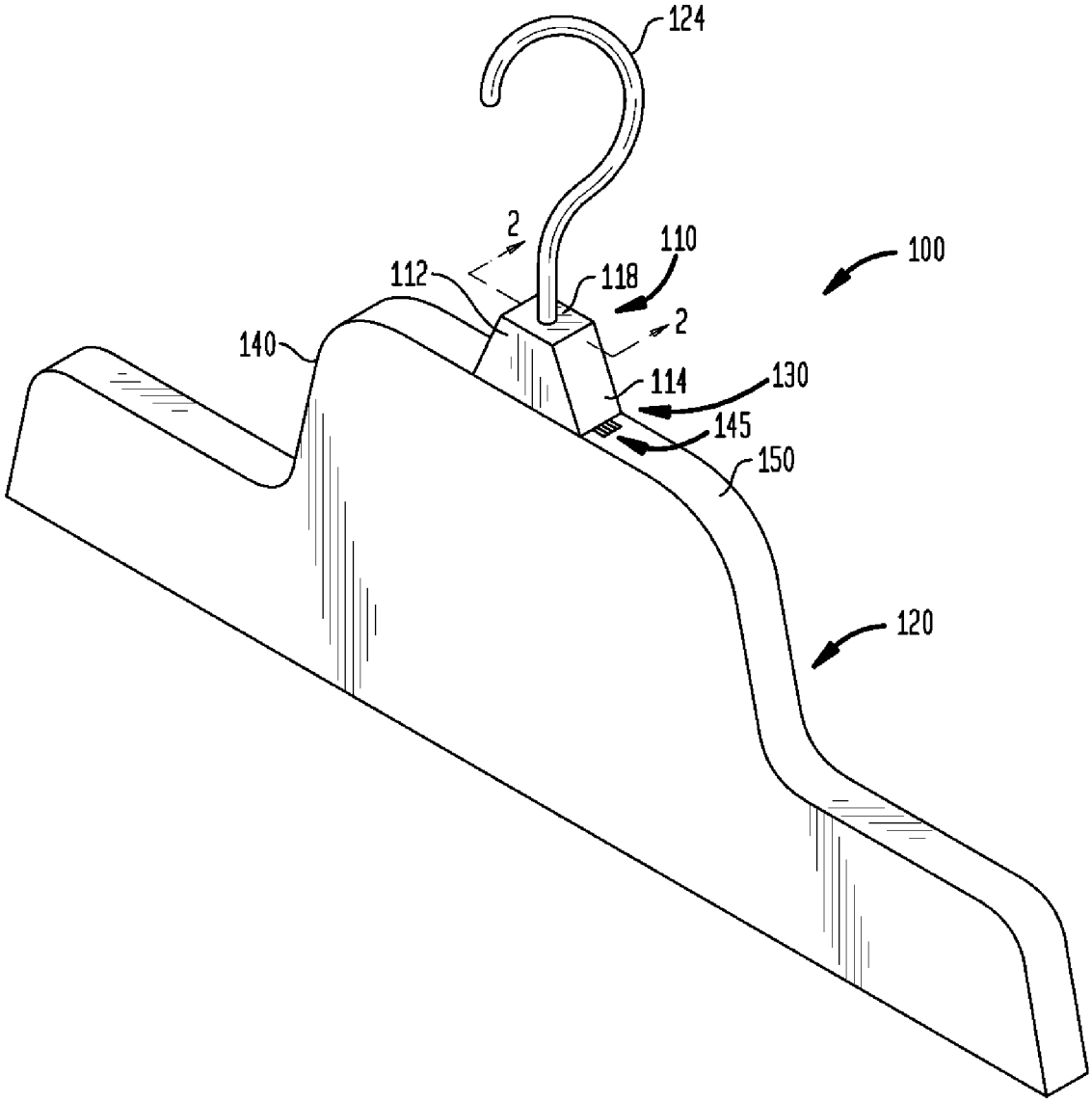
FIG. 1 illustrates a perspective view of a hanger and snap-in sizer indicator assembly according to an embodiment of the present invention.

Referring now to FIG. 1, illustrated in perspective view is a combined assembly 100 including a portion of a hanger 120 and a lower neck indicator hereinafter "indicator") 110 according to an exemplary embodiment of the present invention. The indicator 110 includes, but is not limited to, a size indicator for displaying the size of the garments supported by the hanger 120. The hanger 120 optionally conforms to established industry standards of form, for example, as promulgated by VICS.

In this embodiment, the hanger 120 includes a body 140 and a hook 124 structurally connected to the body 140 at a lower neck region 130 of the hanger 120 where the hook 124 joins the body 140 for suspending the hanger 120 from a support (not shown). In FIG. 1, the hook 124 is shown as a turnable metal wire hook rotatably mated to the body 140. However, it should be understood that any suitable type of hook, such as a plastic hook molded integrally with the hanger body, can be used depending on the application circumstances of the hanger. The body 140 has at least one recess 145 in a top surface 150 thereof for securing the indicator 110. The indicator 110 generally surrounds the lower portion of the wire hook 124 at the lower neck region 130 where the wire hook 124 intersects the body 140.

Figure 2:
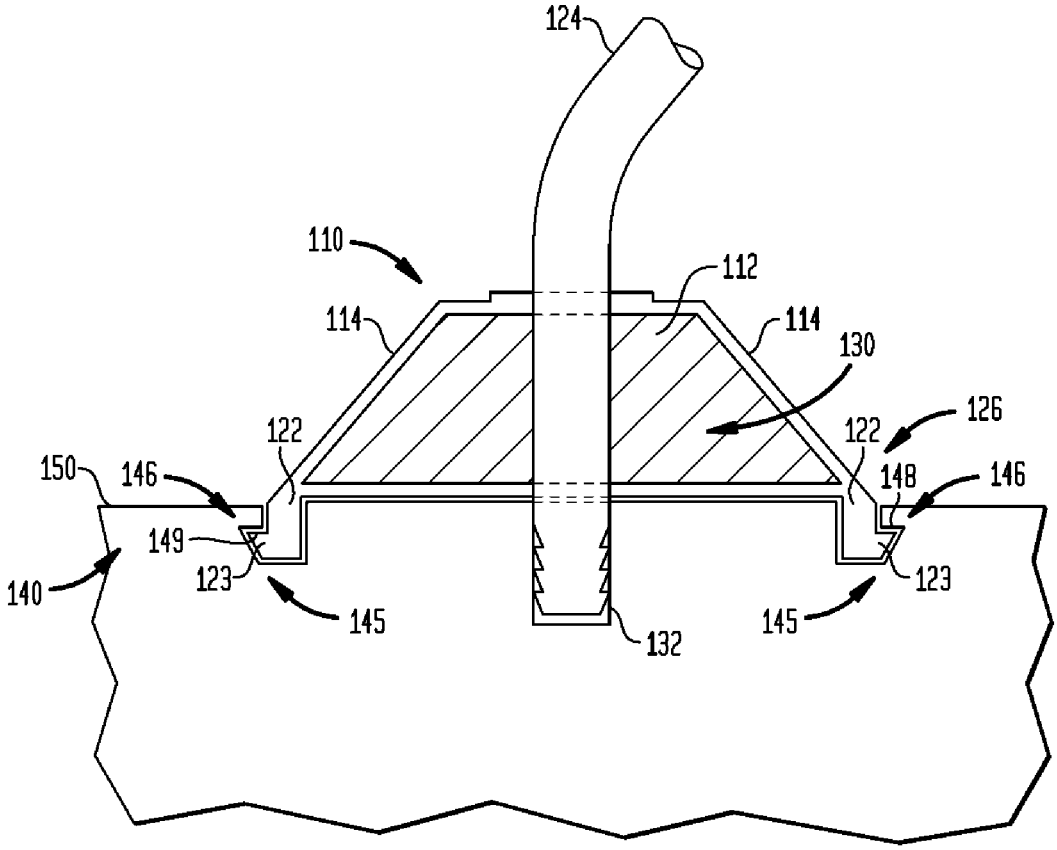
FIG. 2 illustrates a cross section view through the hanger and snap-in sizer indicator assembly, taken along line 2-2 of FIG. 1.

Referring now to FIG. 2, illustrated is a sectional view taken along line 2-2 of FIG. 1. Although a variety of configurations are possible for securing the hook 124 to the hanger 120, in the exemplary embodiment shown in FIG. 2, the body 140 includes an opening 132 for receiving the turnable wire hook 124. As also shown, the indicator 110 has a pair of opposite side walls 112 (only one sidewall shown in this view) connected by a pair of opposite end walls 114. The sidewalls 112 of the indicator 110 are generally trapezoidal in profile, while the end walls 114 are generally rectangular in profile. However, it should be understood that the side walls and end walls of the indicator may assume any other suitable shape and configuration.

The indicator 110 also includes at least one resilient tab 122 attached to a bottom surface 126 thereof for engaging the recess 145 in the top surface 150 of the body 140. The resilient tab 122 includes at least one projection 123 extending outwardly from the end wall 114. In the shown exemplary embodiment, the indicator 110 includes a pair of resilient tabs 122 for engaging a pair of recesses 145 respectively. However, the number of resilient tabs contained by the indicator 110 is not limited to the shown embodiment. Furthermore, although it is shown that the pair of resilient tabs 122 are disposed at the two opposite ends of the indicator 110, it should be understood that the resilient tabs 122 may be disposed at other suitable locations along the bottom surface 126 of the indicator 110.

During operation, the recesses 145 are adapted to receive and secure the resilient tabs 122 in order to attach the indicator 110 to the top surface 150 of the hanger 120. Each recess 145 is illustrated as a step-wise recess, but may be embodied as a concave recess, a chamfer or any other suitable receptacle. Moreover, each recess 145 includes a niche 146, sized and positioned to receive the projection 123 and secure the indicator 110 to the hanger body 140. Specifically, the niche 146 is designed to allow the indicator 110 to be forcefully snapped into the recesses 145 of the top surface 150, under the resilient deformation of the tabs 122 of the indicator 110.

The projection 123 has a first surface 147 and a second surface 149. For example, the first surface 147 is generally horizontal to engage a generally horizontal surface 148 of the niche 146 to inhibit upward motion of the indicator 110 once the indicator 110 is snapped into the hanger 120. Inversely, where the first surface 147 is sloped upward (not shown in FIG. 2), resistance to removal would be reduced. For example, the second surface 149 is sloped relative to the upward surface 148, which effectively reduces resistance and aids in ease of engagement with body 140.

The degree of flexibility of the resilient tabs 122 can be manipulated by adjusting the material, thickness, and/or dimensions of each resilient tab 122. Moreover, the dimensions of the resilient tabs 122 and/or the recesses 145 can be altered to increase or decrease the resistance to removing the indicator 110. In a preferred embodiment, the indicator 110 is child resistant, as defined by relevant industry standards, e.g., those promulgated by Bureau Veritas Consumer Product Services, Inc.

Figure 3A:
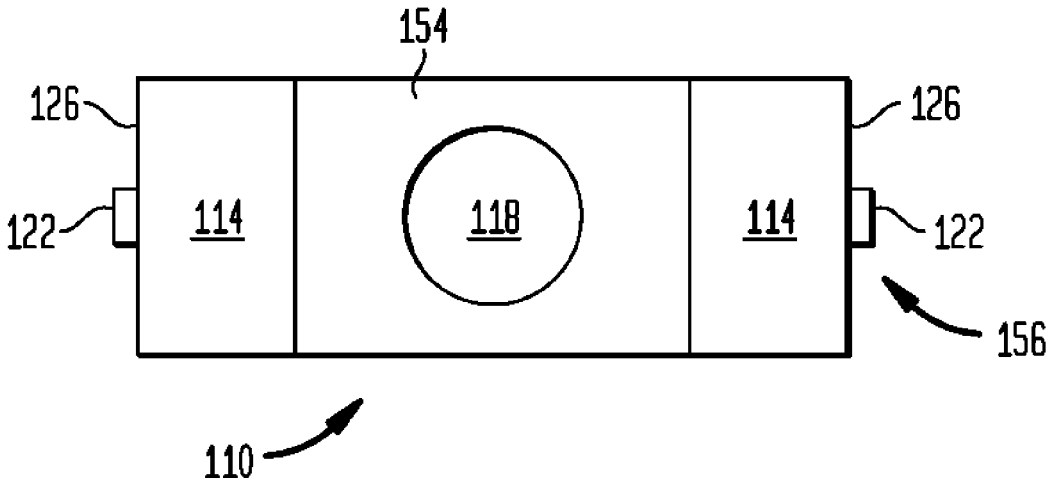
FIG. 3*a* illustrates a top view of the indicator according to an embodiment of the invention.
Figure 3B:
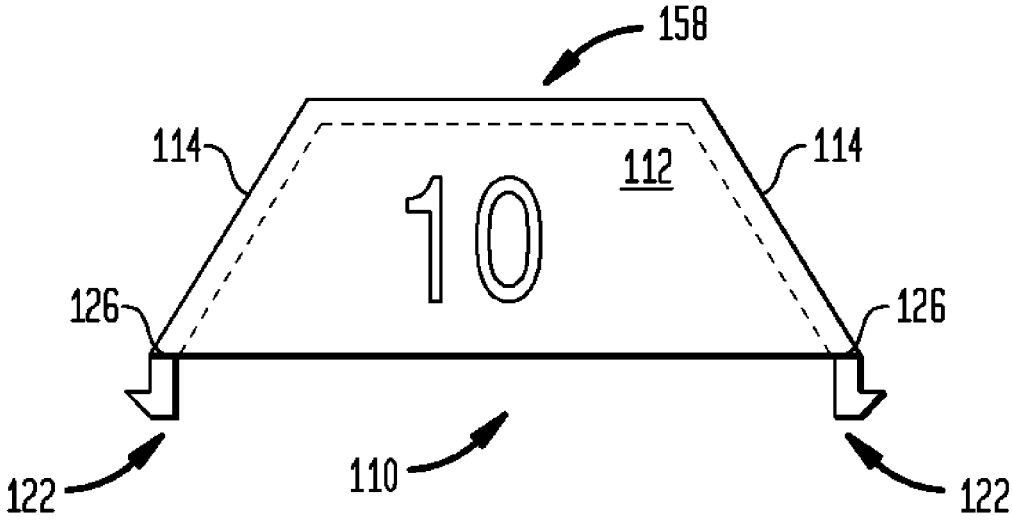
FIG. 3*b* illustrates a side view of the indicator according to an embodiment of the present invention.

Referring now to FIGS. 3*a*-3*b*, the indicator 110 according to an embodiment of the present invention will be described in further detail. FIG. 3*a* shows a top view of the indicator 110. As shown in FIG. 3, the indicator 110 includes an opening 118 formed through a top surface 154 of the indicator 110. In use, the indicator 110 passes over the wire hook 124, with the wire hook 124 passing through the opening 118. However, it should be understood that the opening of the indicator can assume any other suitable profile or configuration other than opening 118 in the top surface 154 of the indicator 110, or even exclude the top surface. For example, the opening can be defined by the side walls 112 and the end walls 114, connected to each other to provide a generally continuous wrap around the hook 124.

As depicted, the resilient tabs 122 are attached to a central portion 156 of the bottom surface 126 of the sidewalls 114. In this embodiment, indicator 110 has a generally hollow central cavity (not shown) defined by the side walls 112, the end walls 114 and the top surface 154 of the indicator 110. The bottom of the indicator 110 remains open in order to receive the hook 124 during assembly. As the lower neck indicator 110 is pressed into engagement with the hanger body 140, the tabs 122 are deformed due to their resilience so as to be admitted by the recesses 145.

Furthermore, without departing from the concept of the present invention, different variations, with respect to the location and configuration of the indicator 110, are also applicable. For example, the indicator 110 does not necessarily pass over the hook 124 to rest around the hook 124, but rather the indicator 110 may be assembled to the hanger body 140 at any suitable location to provide a best perspective for viewing the content on the indicator. Furthermore, the indicator 110 is not necessarily a closed structure to surround the hook 124. For example, the indicator 110 may be a partially closed structure hugging the hook 124, instead of surrounding the hook 124.

As shown in FIG. 3*b*, the indicator 110 may also have sizing indicia 158 printed or molded thereon. The indicia 158 may be printed on the sidewalls 112, as shown, or on the end walls 114. Additionally, the color of the indicator itself may be indicative. Moreover, the indicia 158 may refer to another characteristic of an article to be hung from the hanger, for example, manufacturer or color, among others. Such indicia 158 maybe combined to refer to multiple and/or independent characteristics.

The hanger 120 and/or indicator 110 of the present invention can be molded out of conventional thermoplastic materials via injection molding techniques known to a person of ordinary skill in the art. A typical injection molded plastic, for both the indicator 110 and the hanger 120, may be one or more of polystyrene, SAN, ABS, PPO, nylon, polypropylene (PP), polyethylene, PET, polycarbonates (PC), acrylics, K-resin, polyvinyl chloride (PVC), or others.

The present invention has been described herein with respect to certain exemplary or preferred embodiments. Certain alterations and/or modifications will be apparent to those skilled in the art, in light of the instant disclosure, without departing from the spirit or the scope of the invention. These embodiments are offered as merely illustrative, and not limiting, on the scope of the invention, which is defined solely with reference to the following appended claims.

The invention claimed is:

1. A combination hanger and indicator, the combination comprising:

a hanger having a body and a hook extending upward from the body, the body having at least one recess in a top surface thereof; and an indicator comprising a top opening substantially defined in a top plane and a bottom opening substantially defined in a bottom plane, the top opening and the bottom opening being configured to admit the hook, a pair of opposite side walls each having a top surface in the top plane and a bottom surface in the bottom plane, a pair of opposite end walls each having a top surface in the top plane and a bottom surface in the bottom plane, the side walls and the end walls being connected with each other, and at least one resilient tab extending downwardly from a bottom surface of at least one of the side walls and the end walls for engaging the at least one recess in the top surface of the body.

2. The combination hanger and indicator according to claim 1, wherein the recess comprises a step-wise recess.

3. The combination hanger and indicator according to claim 1, wherein the side walls of the indicator are generally trapezoidal in profile.

4. The combination hanger and indicator according to claim 1, wherein the resilient tab is attached to a central portion of a bottom surface of the end walls.

5. The combination hanger and indicator according to claim 1, wherein the resilient tab comprises a projection extending outwardly from the tab.

6. The combination hanger and indicator according to claim 5, wherein said at least one recess comprises a niche, sized and positioned to receive the projection.

7. The combination hanger and indicator according to claim 6, wherein the niche comprises a generally horizontal surface.

8. The combination hanger and indicator according to claim 5, wherein the projection comprises a generally horizontal surface.

9. The combination hanger and indicator according to claim 1, wherein the indicator comprises two resilient tabs and the body comprises two recesses for receiving the resilient tabs, respectively.

10. The combination hanger and indicator according to claim 9, wherein the two resilient tabs are disposed on opposite sides of the indictor.

11. The combination hanger and indicator according to claim 10, wherein the two opposable resilient tabs are disposed on opposite end walls of the indicator.

12. An indicator for a hanger having a body and a hook attached to the body, the indicator comprising a top opening substantially defined in a top plane and a bottom opening substantially defined in a bottom plane, the top opening and the bottom opening being configured to admit the hook, a pair of opposite side walls each having a top surface in the top plane and a bottom surface in the bottom plane, a pair of end walls each having a top surface in the top plane and a bottom surface in the bottom plane, the side walls and the end walls connected to each other, and at least one resilient tab extending downwardly from a bottom surface of at least one of the side walls and the end walls for engaging at least one recess in a top surface of the body.

13. The indicator according to claim 12, wherein the side walls of the indicator are generally trapezoidal in profile.

14. The indicator according to claim 12, wherein the resilient tab is attached to a central portion of a bottom surface of the end walls.

15. The indicator according to claim 12, wherein the resilient tab comprises a projection extending outwardly from the resilient tab.

16. The indicator according to claim 15, wherein the projection comprises a generally horizontal surface.

17. The indicator according to claim 12, wherein the indicator comprises two resilient tabs.

18. The indicator according to claim 17, wherein the two resilient tabs are located on opposite sides of the indictor.

19. The indicator according to claim 17, wherein the two resilient tabs are located on the opposite end walls of the indicator.

20. The indicator according to claim 12, wherein the recess comprises a step-wise recess positioned to receive the resilient tab.

* * * * *